US009102155B2

(12) United States Patent
Buschmann

(10) Patent No.: US 9,102,155 B2
(45) Date of Patent: Aug. 11, 2015

(54) METHOD TO CLEAN NOZZLES OF AT LEAST ONE INK PRINT HEAD WITH A FLUSHING MEDIUM IN AN INK PRINTING APPARATUS

(71) Applicant: Stefan Buschmann, Poing (DE)

(72) Inventor: Stefan Buschmann, Poing (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 13/738,371

(22) Filed: Jan. 10, 2013

(65) Prior Publication Data

US 2013/0176360 A1 Jul. 11, 2013

(30) Foreign Application Priority Data

Jan. 10, 2012 (DE) ..... 10 2012 100 125

(51) Int. Cl.
*B41J 2/165* (2006.01)

(52) U.S. Cl.
CPC ..... *B41J 2/16552* (2013.01)

(58) Field of Classification Search
CPC ..... B41J 2/16552; B41J 2/185; B41J 2/1707; B41J 2/16538; B41J 2/16585
See application file for complete search history.

(56) References Cited

U.S. PATENT DOCUMENTS

| | | | | |
|---|---|---|---|---|
| 5,572,242 | A | 11/1996 | Fujii et al. | |
| 6,042,214 | A | 3/2000 | Minowa et al. | |
| 6,578,945 | B2 | 6/2003 | Hashi et al. | |
| 7,775,626 | B2 * | 8/2010 | Taga et al. | 347/30 |
| 7,909,450 | B2 * | 3/2011 | Yamauchi et al. | 347/102 |
| 8,029,092 | B2 * | 10/2011 | Yoda et al. | 347/33 |
| 2002/0180851 | A1 * | 12/2002 | Saruta | 347/86 |
| 2011/0035164 | A1 * | 2/2011 | Tsuchiya et al. | 702/45 |
| 2012/0229565 | A1 * | 9/2012 | Yuda et al. | 347/35 |

FOREIGN PATENT DOCUMENTS

| | | |
|---|---|---|
| DE | 69311397 | 8/1993 |
| DE | 69707962 | 10/1997 |
| EP | 1013435 | 6/2000 |
| EP | 0788882 | 7/2002 |
| JP | 07047696 | 2/1995 |

* cited by examiner

*Primary Examiner* — Manish S Shah
*Assistant Examiner* — Jeremy Delozier
(74) *Attorney, Agent, or Firm* — Schiff Hardin LLP

(57) ABSTRACT

In a method to clean nozzles and ink channels of at least one ink print head with a flushing medium in an ink printing apparatus, a necessary flushing quantity of the flushing medium that is to be provided and which is necessary for flushing of the ink print head in a flushing process is determined from either a predetermined flushing quantity predetermined depending on a print duration of the ink printing apparatus or from a drive flushing quantity derived from a flushing quantity curve that indicates a dependency of the flushing quantity on an elapsed time for an ink used in printing, the necessary flushing quantity being either said predetermined flushing quantity or the derived flushing quantity, whichever is greater. The determined necessary flushing quantity is used to flush the ink print head.

6 Claims, 6 Drawing Sheets

METHOD TO CLEAN NOZZLES OF AT LEAST ONE INK PRINT HEAD WITH A FLUSHING MEDIUM IN AN INK PRINTING APPARATUS

BACKGROUND

Ink printing apparatuses can be used for single or multi-color printing of a printing substrate web, for example a single sheet or a belt-shaped recording medium made of the most varied materials (for example paper). The design of such ink printing apparatuses is known; see for example EP 0 788 882 B1. Ink printing apparatuses that operate according to the drop-on-demand (DoD) principle, for example, have a print head or multiple print heads with nozzles comprising ink channels, the activators of which nozzles—controlled by a printer controller—excite ink droplets in the direction of the printing substrate web, which ink droplets are deflected onto the printing substrate web in order to apply printing dots there for a print image. The activators can generate ink droplets thermally (bubble jet) or piezoelectrically.

In an ink printing apparatus, the ink that is used is adapted in terms of its physical/chemical composition to the print head; for example, the ink is adapted with regard to its viscosity. Given low print utilizations of the ink printing apparatus, not all nozzles of the ink print heads are activated in the printing process; many nozzles have downtimes (print pauses), with the consequence that the ink in the ink channel of these nozzles is not moved. Due to the effect of evaporation from the nozzle opening, the danger exists that the viscosity of the ink then varies. This has the consequence that the ink in the ink channel can no longer move optimally and escape from the nozzle. In extreme cases, the ink in the ink channel dries up completely and jams the ink channel, such that a printing with this nozzle is no longer possible.

A drying of ink in the nozzles of a print head during its printing pauses represents a problem that can be avoided in that a flushing medium (for example ink or cleaning fluid) is flushed through all nozzles within a predetermined cycle. This flushing cycle can be adjusted corresponding to the print utilization.

From U.S. Pat. No. 6,578,945 B2 it is known to avoid the drying out of the nozzles of the print heads in an ink printing apparatus with a printing unit made up of multiple print heads, since the print heads are sealed with protective caps. The ink dispensed from the nozzles upon cleaning is accepted by the protective caps. In order to attach the protective caps to the print heads, the printing unit with the print heads is moved upward, away from the printing substrate, the protective caps are driven into the intervening space between printing unit and printing substrate, and the print heads are thereby cleaned. The protective caps are moved upward toward the print heads via elastic force, wherein the print heads are covered. The protective capacity unit remains in this position until the printing unit should be used for printing again.

Upon cleaning the flushing medium (ink, for example) is pushed or sucked through the nozzles and ink channels of the print head via overpressure or negative pressure. This flushing medium is then subsequently stripped (called wiping) with a stripping unit (blade, scraper), for example a rubber lip or multiple rubber lips. For this the print head can be driven over the stripping unit or the stripping unit can be driven over the print head. An exact positioning of the print head relative to the stripping unit is necessary in order to ensure a constant overlapping between the stripping unit and the print head.

Given use of a flushing medium to clean the nozzles of a print head, the following problems are to be considered, for example:

- The flushing medium that is used in the cleaning of the nozzles is normally not reusable and is viewed as a loss. One goal is therefore to reduce the amount of flushing medium that is used as much as possible.
- The necessary amount of flushing medium is dependent on a state of the ink in the print head, which ink is used in the printing. If the print head has not been used for a long period of time, the ink is more severely dried out and a greater quantity of flushing medium is required in order to sufficiently clean the nozzles.
- Furthermore, a cleaning of the nozzles of a print head is additionally necessary after a longer period of time of the printing operation. A small quantity of ink vapor (small droplets) that arises during printing operation deposits on a nozzle plate. The droplets there can lead to problems. On the one hand, such a droplet can lead to a nozzle opening which deflects the ink droplets. On the other hand, these droplets can dry out and arrive in the nozzle as interfering particles in the next cleaning.

A method according to which the consumption of flushing ink is adapted to the use of the printing apparatus before the cleaning (for example during the printing operation or in print pauses) is known from DE 697 07 962 T2 and DE 693 11 397 T2. According to DE 693 11 397 T2, the duration of the print pauses is measured, and depending on this the number of pulse-like flushing processes during which flushing ink is flushed through the nozzles of the print head is adjusted. According to DE 693 11 397 T2, the duration of the print pauses is likewise measured and the number of pulse-like flushing processes is established depending on the duration of the print pauses. The number of flushing processes is thereby also dependent on the behavior of the ink during the print pause.

SUMMARY

It is an object to specify a method to clean the nozzles and ink channels of a print head in an ink printing apparatus in which the amount of flushing medium used in the cleaning of the print head is established based on consideration of the duration of print pauses and additional parameters of the printing operation. Such parameters are, for example, the properties of the ink used in the printing, or whether or not print head is covered with a protective cap during a print pause. An additional parameter is present if ink droplets deposit on the nozzle surface during the printing operation, which ink droplets must be removed.

In a method to clean nozzles and ink channels of at least one ink print head with a flushing medium in an ink printing apparatus, a necessary flushing quantity of the flushing medium that is to be provided and which is necessary for flushing of the ink print head in a flushing process is determined from either a predetermined flushing quantity predetermined depending on a print duration of the ink printing apparatus or from a drive flushing quantity derived from a flushing quantity curve that indicates a dependency of the flushing quantity on an elapsed time for an ink used in printing, the necessary flushing quantity being either said predetermined flushing quantity or the derived flushing quantity, whichever is greater. The determined necessary flushing quantity is used to flush the ink print head.

DESCRIPTION OF PREFERRED EXEMPLARY EMBODIMENTS

Figure 1:
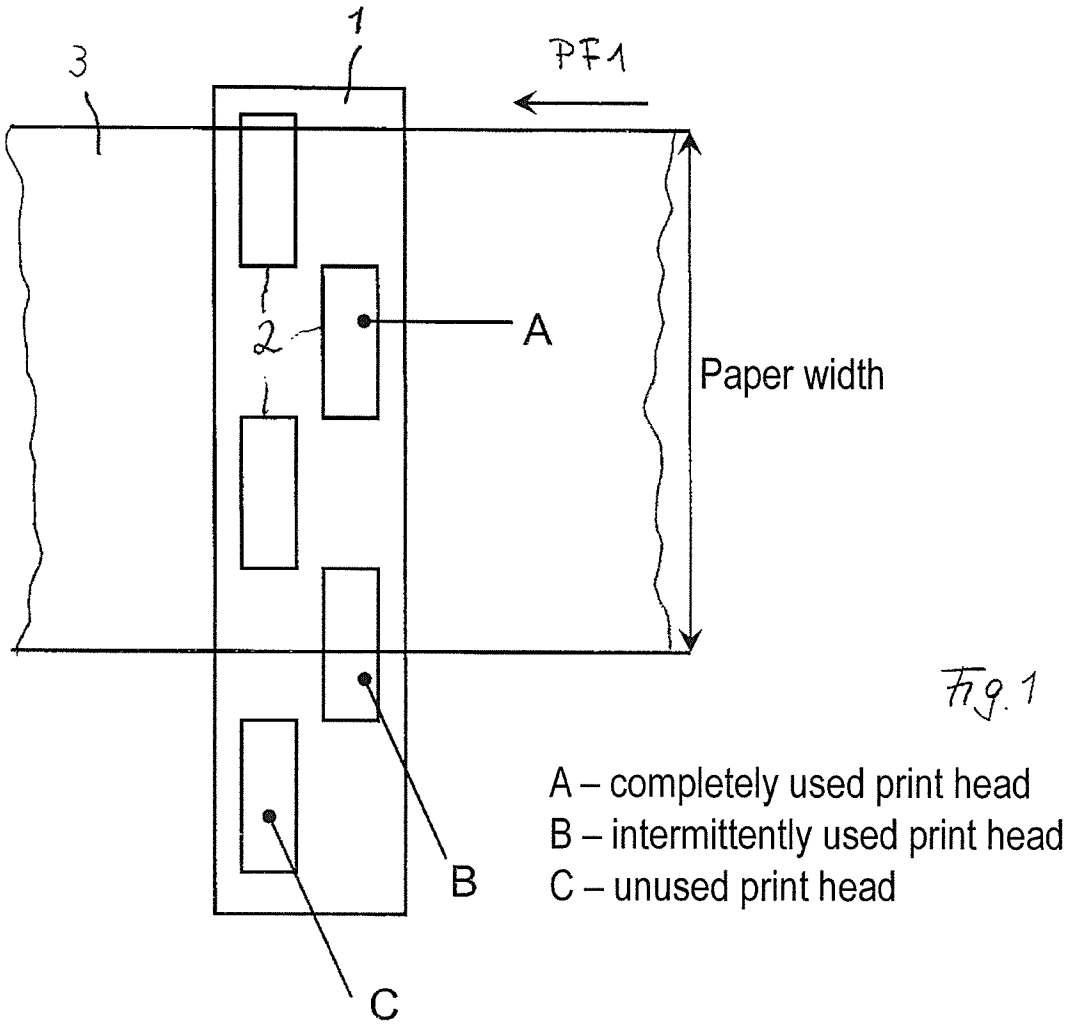
FIG. 1 is a principle presentation of a known print bar with five print heads.

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated are included as would normally occur to one skilled in the art to which the invention relates.

The flushing quantity of a flushing medium that is necessary to flush a print head is thus determined according to the following:

- a flushing quantity curve is established for the print head in a printing apparatus, which flushing quantity curve indicates the dependency of the flushing quantity (that is necessary for the flushing of the print head) on the elapsing time (thus for a flushing cycle) for an ink used in the printing, beginning with a flushing process for the print head; and
- before execution of a new flushing process, from the amount of time that has elapsed since the preceding flushing process the flushing medium associated with this amount of time is determined from the flushing quantity curve, and this flushing quantity is used to flush the print head.

The following terms are used in the explanation of the method according to preferred exemplary embodiments:

- the quantity of flushing medium that is required and sufficient for the cleaning of the nozzles with ink channels is designated as a necessary flushing quantity;
- an ink or a cleaning fluid can be used as a flushing medium;
- in a flushing process, the nozzles of a print head are flushed with the necessary flushing quantity and are thereby cleaned;
- the time interval of two successive flushing processes (the flushing cycle) can be predetermined by the operator of the printing apparatus; and
- the method can, for example, be stored as a table or software in a printing controller of the printing apparatus.

The method according to the exemplary embodiments therefore have the following advantages:

- the quantity of flushing medium for flushing the nozzles and ink channels of a print head is established using the duration of the printing pause and the parameters listed above, and the flushing quantity that is used can thereby be reduced;
- a high certainty is achieved since all nozzles are operationally ready due to the use of the determined necessary flushing quantity; and
- the method can be used without changing the hardware of the printing apparatus.

The exemplary embodiments are explained further using FIGS. 1 through 7.

FIG. 1 schematically shows a print bar 1 of a printing unit with ink print heads 2 as a known part of an ink printing apparatus. The print heads 2 have nozzles (in a known manner) with ink channels (not shown—in the following the unit of nozzle and ink channel is abbreviated as "nozzle"), that can generate ink droplets according to the DoD principle, which ink droplets are directed onto a printing substrate 3 in order to generate a print point there. The print heads 2 work together with a printer controller (not shown) that derives control signals for the individual nozzles of the print heads from the data stream mapping the print image. From the data stream, control signals are derived that control those nozzles of the print heads 2 that should generate a print point on the printing substrate 3.

Figure 2:
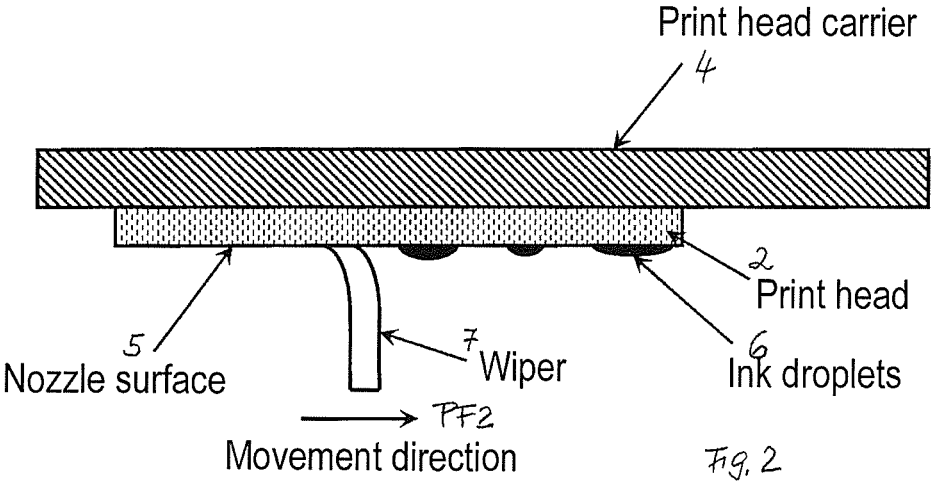
FIG. 2 is a principle presentation of a cleaning device for the nozzle surface of a print head.

As an example, FIG. 2 shows a cleaning device for a print head 2 arranged on a print head carrier 4, the nozzle surface 5 of which print head should be cleaned, on which nozzle surface 5 ink droplets 6 have deposited that should be removed. The cleaning device has a cleaning element 7 that provides a cleaning blade, for example a rubber blade. The ink droplets 6 are stripped off with a movement of the cleaning blade 7 in the direction of the arrow PF1 on the nozzle surface 5, and the nozzle surface 5 is cleaned. The cleaning of the nozzles takes place with the aid of a flushing medium (for example a flushing ink) that is flushed through the nozzles of the print head 2. A goal of the exemplary embodiments is to determine the quantity "m" of flushing medium that is necessary and sufficient in order to flush through and clean the nozzles of the print head 2.

In order to minimize the quantity "m" of necessary flushing medium, the parameters must be established that affect the quantity "m" of flushing medium that are required to clean the print head. For example, it must thereby also be taken into account that—according to FIG. 1—a print head A is entirely utilized during printing, a print head B is partially utilized during printing, or a print head C remains unused. Additionally, it must also be taken into account whether the respective print head 2 (that is not used) in the printing apparatus is covered by a protective cap in order to prevent the ink in the nozzles of the print head 2 from drying out.

For the determination of the quantity "m" of the flushing medium to clean the nozzles of a print head 2, at least the following parameters are to be taken into account:

The pause time $t_{capped}$ for a print head 2 of the printing apparatus, thus the time of disuse of a print head 2 of the printing apparatus when the print head 2 is covered with a protective cap. Counting towards this is also the time in which the printing apparatus is deactivated. In this case, the print head 2 can also be protected from quickly drying out by a protective cap in a park position.

During the printing a print head 2 can be unused wholly (print head C, FIG. 1) or in part (print head B, FIG. 1). This time period $t_{uncapped}$ in which the print head 2 is not covered by a protective cap leads to the nozzle of the print head 2 drying out relatively quickly. As a result of this, the quantity of flushing medium must be increased more quickly depending on the time interval between successive flushing processes.

Since the aforementioned parameters act identically on all nozzles in a print head 2, an only partially utilized print head 2 (print head B, FIG. 1) must be treated like a completely unused print head 2 (print head C, FIG. 1).

Furthermore, the print time $t_{print}$ of the print head 2 is to be considered due to the unwanted deposition of ink droplets on the nozzle surface 5.

The following parameters are thus to be considered for the determination of the flushing quantity "m" of flushing medium:

$$m_{Ink}=f(k_{capped}, t_{capped}, k_{uncapped}, t_{uncapped}, t_{print}) \quad (1)$$

m=quantity of flushing medium (=flushing quantity) that is required to clean the nozzles of a print head 2; this is dependent on the time between two flushing processes. In Formula (1), ink is used as a flushing medium. This time can be selected by the operator of the printing apparatus.

t=time beginning from a flushing process k=correction factor

In order to take into account the varying speed of the drying of the ink in a print head 2, correction factors $k_{capped}$ and $k_{uncapped}$ are introduced. These must be determined empirically in the printing apparatus that is used and can be dependent on the ink that is used in printing.

Figure 3:
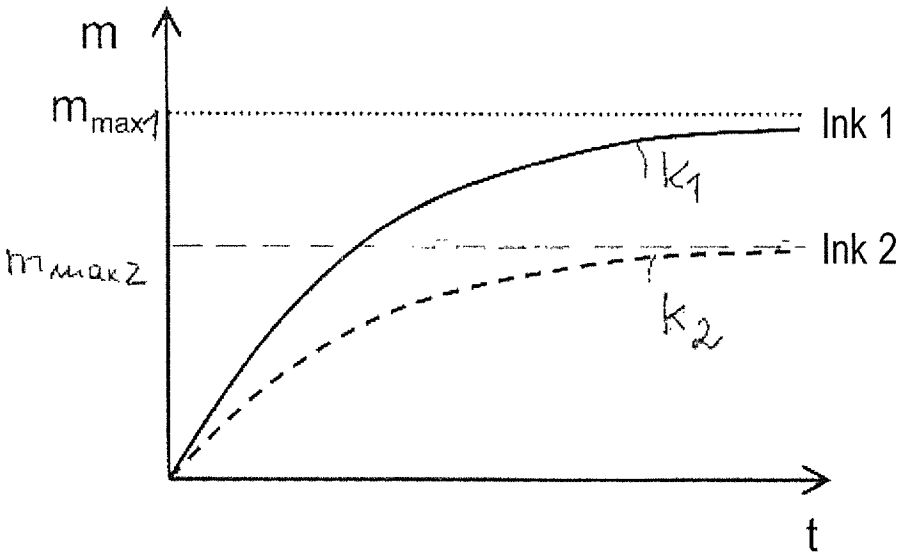
FIG. 3 is a graphical presentation of the flushing quantity for a flushing process for a print head given use of different inks, depending on the time interval of two successive flushing processes (flushing quantity curve)

As an exemplary embodiment, in a printing apparatus the dependency of the flushing quantity "m" on the time t for two different inks (which dependency is determined via measurements) can be represented approximately by the flushing quantity curves $k_1$, $k_2$ of FIG. 3. In this exemplary embodiment the flushing quantity "m" can be simulated by an e-function (FIG. 3) that reaches a different maximum value $m_{max1}$, $m_{max2}$ depending on the tested inks. $m_{max}$ is thereby the maximum value of flushing quantity that can be achieved given a longer time interval of the flushing processes. If the time interval is chosen to be shorter, the necessary flushing quantity "m" can be smaller than $m_{max}$, corresponding to the curve progression of FIG. 3.

Figure 4:
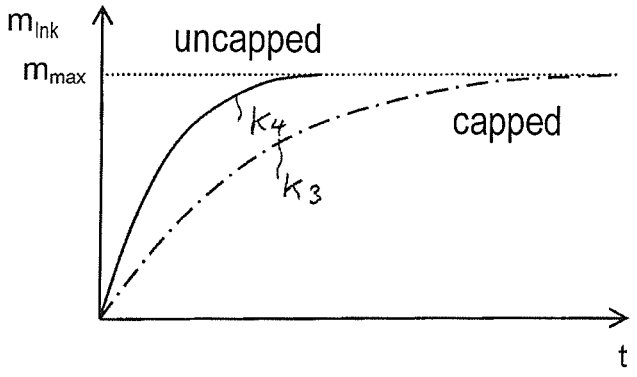
FIG. 4 is a graphical presentation of the flushing quantity curve for a print head given use of an ink depending on the time interval of two successive flushing processes, wherein the print head is intermittently covered or not covered with a protective cap.

For an ink, a flushing quantity curve $k_3$ for the flushing quantity $m_2=m_{capped}$, or respectively $k_4$ for the flushing quantity $m_1=m_{uncapped}$, can be measured according to FIG. 4 depending on the fact of whether a print head 2 is covered with a protective cap or not (was capped or was not capped) during the time of disuse. It is to be recognized that, given a print head 2 that is not capped during its printing pause, the maximum flushing quantity $m_{max}$ is reached after a shorter amount of time t in comparison to a print head 2 that is capped during its printing pause. For the curves $k_3$, $k_4$ of FIG. 4 in the exemplary embodiment the following functions ((2), (3)) can be assumed for the quantity "m" of flushing medium, depending on whether the print head 2 is covered with a protective cap or not:

$$m_{Ink}=m_{max}(1-e^{k_{Ink}\cdot k_{capped}\cdot t_{capped}})=m_2 \text{ for the capped state or, respectively,} \quad (2)$$

$$m_{Ink}=m_{max}(1-e^{k_{Ink}\cdot k_{uncapped}\cdot t_{uncapped}})=m_1 \text{ for the uncapped state.} \quad (3)$$

Since a print head 2 can both be capped (in the park position, for example) and uncapped in the printing position between two flushing processes, both portions $m_1$, $m_2$ must be taken into account in the calculation of the flushing quantity "m". This case can be graphically represented according to FIG. 5. In this example, the print head 2 was not capped for the time period $\Delta t_1$, this from the point in time t=0 until the point in time $t=t_1$. This means that the print head 2 dries relatively quickly in the uncapped state, and the necessary flushing quantity $m_2$ increases rapidly (flushing quantity curve $k_4$). The print head 2 was subsequently parked for the time period $\Delta t_2$, and it was located in a capped state (flushing quantity curve $k_3$). The state of the print head 2 at the point in time of parking is to be considered for the calculation of the additional flushing quantity "$m_2$". An equivalent time $t_1$ is determined for this that corresponds to the state of the capped print head 2 (meaning that $m_2=m_1$). "m" subsequently follows the curve $k_3$. The time period $\Delta t_2$ in which the print head 2 was capped is subsequently added to $t_{1*}$, and $t_2$ results. $t_2$ thus corresponds to a time equivalent that includes both the uncapped time period of the print head 2 and the capped time period. The necessary flushing quantity can then be calculated from this by means of Formula (2).

Figure 5:
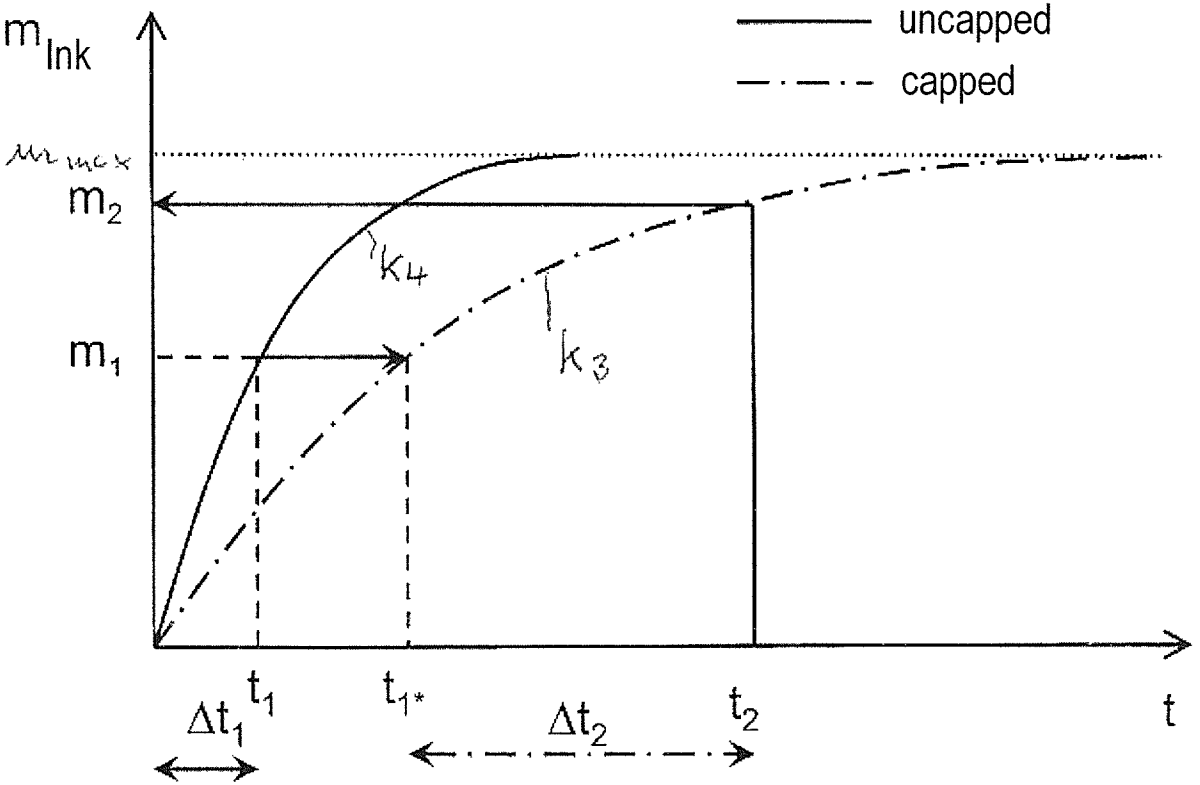
FIG. 5 is a graphical presentation of the flushing quantity curve for a print head given use of an ink depending on the time interval of two successive flushing processes, wherein the print head is intermittently covered and not covered with a protective cap, to explain the calculation of the necessary flushing quantity.

From (3), for FIG. 5 $m_1$ can be calculated as $$m_1=m_{max}(1-e^{k_{Ink}\cdot k_{uncapped}\cdot t_{\cdot}})$$

$m_1$ is the flushing quantity when the print head 2 is without a protective cap.

With $m_1$, the time equivalent $t_2$ for a capped print head 2 can subsequently be calculated as follows:

$$t_2=\ln\left(1-\frac{m_1}{m_{max}}\right)\Big/(k_{Ink}\cdot k_{capped})$$

With $t_2=\Delta t_2+t_{1*}$, follows that:

$$m_2=m_{max}(1-e^{k_{Ink}\cdot k_{capped}\cdot t2})$$

In the example of FIG. 5, $m_2$ is the flushing quantity that is required in order to clean a print head 2 that was intermittently covered by a protective cap and intermittently not covered.

Figure 6:
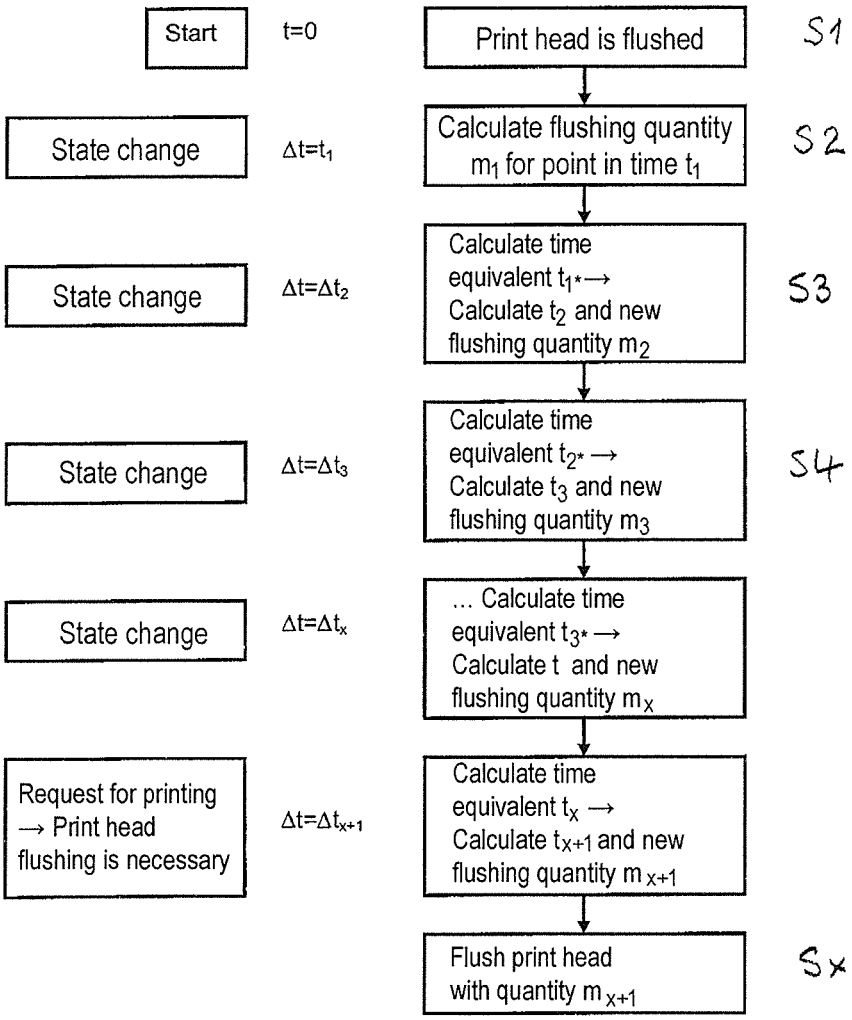
FIG. 6 is a workflow diagram that depicts the determination of the necessary flushing quantity for a print head.

This calculation can analogously also be extended to multiple state changes; state changes are thereby times at which the print head 2 was covered or not covered (with a protective cap, for example). The diagram according to FIG. 6 shows the workflow of the calculation at multiples of these state changes:

The workflow begins with, for example, a following flushing process at the point in time t=0 (Step S1) and ends with a flushing process (Step Sx). The print head 2 can be intermittently covered or not covered with a protective cap between these points in time; and the flushing quantity "m" that is required for the cleaning of the print head 2 changes accordingly, for example:

S2: calculation of the flushing quantity $m_1$ for the point in time $t_1$—the print head 2 is not covered, for example.

S3: calculation of the flushing quantity $m_2$—the print head 2 is capped for the time period $\Delta t_2$.

S4: calculation of the flushing quantity $m_3$—the print head 2 is uncapped again for the time period $\Delta t_3$ etc.

As has already been described above, interfering residues are also created on the nozzle surface 5 of a print head 2 during the printing operation, which residues must be regularly cleaned off via a flushing process. A minimum quantity $m_{min}$ of flushing medium is necessary for this. The quantity of ejected ink droplets during printing is thereby significant for the point in time of the next necessary cleaning of the print head 2. Since a print head 2 can have a plurality of nozzles that can be spatially situated at a distinct distance from one another, the number of ink droplets per nozzle would be the most precise possibility for qualification. Since such a process would be very complicated, instead of this the printing time $t_{print}$ can be used approximately as a parameter for the flushing quantity $m_{min}$. If a defined printing time $t_{print}$ is exceeded, a cleaning of the print head 2 should be implemented before the next print start. The respective larger flushing quantity $m_{min}$ or $m_x$ (according to FIG. 6) should be drawn upon as the flushing quantity "m" that is used.

The optimal point in time to flush the print head 2 is immediately before the beginning of printing. Upon a request to start printing, the printing apparatus should therefore implement the calculation of the required flushing quantity "m" and then execute the flushing process before beginning printing. However, it is not absolutely necessary that a flushing process takes place before each printing start.

Figure 7:
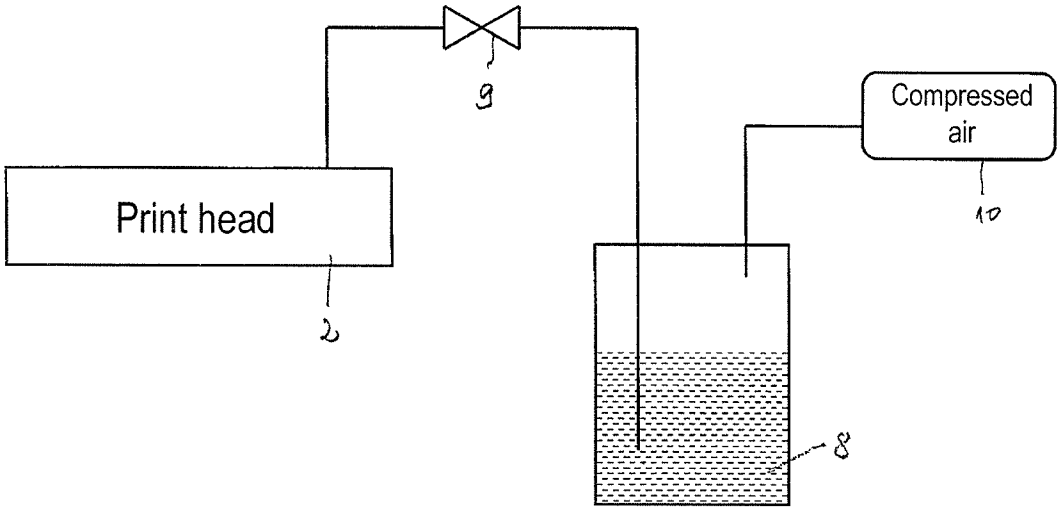
FIG. 7 is an arrangement for dosing the flushing quantity per print head.

The dosing of the quantity "m" of m to clean the print 2 can be implemented corresponding to FIG. 7. A valve 9 is arranged between a reservoir 8 for a flushing medium and the print head 2. A pressure is exerted by a compressed air source 10 on the reservoir 8 so that the flushing medium is supplied to the print head 2 given an open valve 9. The quantity "m" of flushing medium that is fed to the print head 2 can be set by controlling the valve 9. For this the valve 9 can be controlled by the printer controller corresponding to the method according to the exemplary embodiment.

The method according to the exemplary embodiment has been described for one print head 2; and it can be transferred to a plurality of print heads without any additional measures, corresponding to FIG. 1. In this case, the amount of flushing medium that is required for cleaning can be determined for each print head 2, and then each print head can be cleaned with the amount of flushing medium that has been determined for it. For this it is necessary that the required flushing quantity is determined for each print head 2 (in a print bar 1 according to FIG. 1, for example), and that this print head 2 can be flushed with the determined flushing quantity separately from the other print heads 2.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to clean nozzles and ink channels of at least one ink print head with flushing medium in an ink printing apparatus, comprising the steps:

determining a necessary flushing quantity of the flushing medium that is provided and which is necessary for flushing of the ink print head in a flushing process from an unwanted ink deposition flushing quantity to flush unwanted ink deposition droplets which deposit at the print head during printing and thus depends on total printing time of the print head between a first flushing process and a subsequent next second flushing process and from a drying ink flushing quantity to prevent drying of ink caused by print head disuse and thus depends on disuse time of said print head during disuse of the print head between the first and the second flushing processes, said necessary flushing quantity being either said unwanted ink deposition flushing quantity or said drying ink time flushing quantity whichever is greater;

said unwanted ink deposition flushing quantity being derived from a curve stored as a table of flushing quantity versus printing time in a printer controller of the printing apparatus, and the drying ink flushing quantity being derived from at least one flushing quantity stored as a table of flushing quantity versus print head disuse time in said printer controller when the print head is in disuse; and using the determined necessary flushing quantity to flush the ink print head.

2. The method of claim 1 wherein said drying ink flushing quantity is derived from a respective table of flushing quantity versus print head capped disuse time when the capped print head is in disuse and a respective table of flushing quantity versus uncapped disuse time when the uncapped print head is in disuse.

3. The method of claim 1 in which the first and second flushing processes are implemented at a respective first print start and a respective subsequent second print start.

4. The method of claim 1 in which the ink printing apparatus has a plurality of said print heads and the necessary flushing quantity is determined individually for each ink print head, and each ink print head is flushed with its associated necessary flushing quantity.

5. The method of claim 1 wherein a user determines when the first flushing process is to occur.

6. The method of claim 1 wherein a user determines a time interval from the first to the second flushing process.

* * * * *